United States Patent [19]

Tunnicliffe

[11] 4,114,884

[45] Sep. 19, 1978

[54] DARTS

[75] Inventor: Leonard Alfred Tunnicliffe, Walsall, England

[73] Assignee: L.A. & E.W. Tunnicliffe Limited, England

[21] Appl. No.: 768,721

[22] Filed: Feb. 15, 1977

[30] Foreign Application Priority Data

Aug. 24, 1976 [GB] United Kingdom ..... 35098/76

[51] Int. Cl.[2] ..... A63B 65/02

[52] U.S. Cl. ..... 273/106.5 C; 403/290; 403/354

[58] Field of Search ..... 273/106.5 R, 106.5 C; 425/290; 403/290, 354

[56] References Cited

U.S. PATENT DOCUMENTS 2,891,794 6/1959 Meyer ..... 273/106.5 C

FOREIGN PATENT DOCUMENTS 477,821 1/1938 United Kingdom ..... 273/106.5 C
484,292 5/1938 United Kingdom ..... 273/106.5 R
517,651 2/1940 United Kingdom ..... 273/106.5 R
1,313,013 4/1973 United Kingdom ..... 273/106.5 C

*Primary Examiner*—Paul E. Shapiro
*Attorney, Agent, or Firm*—Scrivener, Parker, Scrivener & Clarke

[57] ABSTRACT

A dart has a unitary plastics flight of cruciform cross-section, the four wings being joined directly together at the spine. Before the flight is fitted to the shaft of the dart, the wings are folded flat, one pair on each side of the spine and an aperture is cut through the spine and a small metal cap fitted into it. The flight is unfolded to its cruciform cross-section and the wings fitted into slits in the end of the shaft. The cap fits over the tail end of the shaft to urge together the prongs formed by the slits and to cover the open ends of the slits.

6 Claims, 5 Drawing Figures

DARTS

This invention relates to darts.

In darts with wooden shafts and feathered flights each wing of the flight is separate and secured by adhesive to the shaft. The adhesive is applied between the quill of the feather and the wooden shaft which extends right through the flight. A metal cap is often fitted on the exposed rear end of the shaft to deflect the points of the following darts and protect the wooden shaft from being damaged by them.

For some years there have been darts made with moulded plastics shafts and plastics flights. The wings of these flights are joined directly together so that the flight is selfcontained and has merely to be mounted on the shaft. Longitudinal slits are provided in the tail of the moulded shaft into which the wings of the flight are inserted. The slits are made only as long as is necessary to mount the flight satisfactorily; the slits are difficult to mould and the ends of the shaft tend to splay if the slits are long.

As the ends of the slits are open the points of following darts can become trapped in them and the prongs formed between the slits are sometimes snapped off. To extend the slits sufficiently to enable the end of the shaft to project beyond the flight to be fitted with a cap would not be satisfactory. As the shaft is split into thin portions, by contrast with the solid wooden shaft of a feathered dart, the portions would tend to bow leaving a gap between the portions and the flight which could trap the point of another dart. The long thin shaft portions would be very liable to be broken by a trapped dart point.

It is an object of the present invention to provide protection for the ends of a shaft which has short slits, both against breakage and forming a trap for the point of another dart.

The present invention consists in a dart having a shaft which is slit at the tail end and a flight of which the wings are directly interconnected at the spine of the flight, the forward marginal portions of the wings at the spine being received in the slits and openings being provided in the wings symmetrically about the spine and complementary to a metal cap which receives the tail end of the shaft.

The closed end of the cap is preferably pointed so as to divert the point of a following dart which strikes it. The opening of the cap preferably fits closely over the slit tail end of the shaft urging the prongs formed between the slits together and against the flight.

The invention comprises a method of making such a dart.

The openings may be made in the wings before the flight is fitted to the shaft by piercing the wings while the flight is folded flat, for example in a flight with four wings with the wings folded against one another in pairs on opposite sides of the spine. In this flat state the cut for the opening is preferably of arched shape conforming to the outline of a longitudinal section of the cap and little more in width than the thickness of the wall of the cap. This forms a tongue which can be inserted into the cap while the flight is still flat and assists assembly of the cap and flight. When the wings are opened out the tongue is also opened out to a three dimensional shape, for example, in a flight with four wings it becomes cruciform in shape. The tongue locates the cap co-axially with the spine ready to receive the end of the shaft when the flight is fitted into the slits.

The invention will now be described, by way of example with reference to the accompanying drawings in which.

Figure 1:
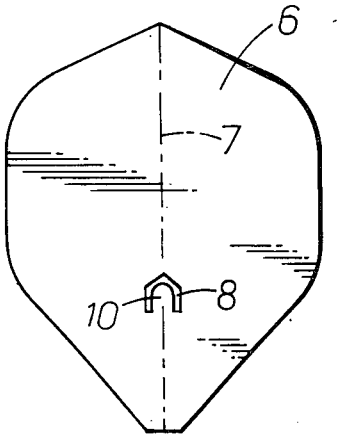
FIG. 1 is a plan view of a flight for a dart according to the invention.
Figure 2:
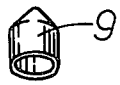
FIG. 2 is a perspective view of a metal cap for the dart.
Figure 3:
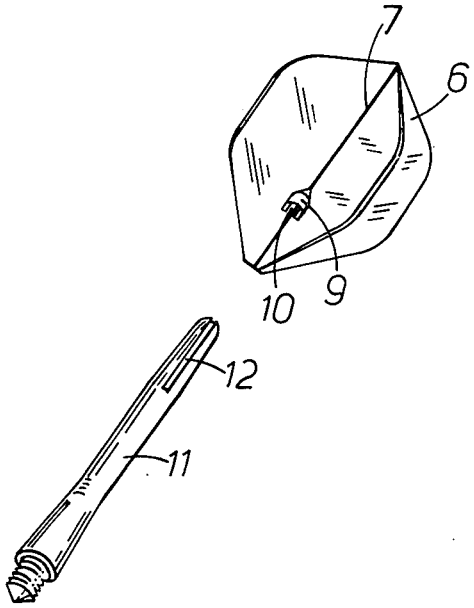
FIG. 3 is an exploded perspective view of a shaft and flight of the dart.

The flight indicated by the reference 6 has four wings which are directly interconnected at the spine 7. In FIG. 1 the wings are shown folded flat. In this condition an opening 8 is pierced through the double thickness of the wings by a cut arched shape. While the flight is still flat the hollow metal cap 9 shown in FIG. 2 can be fitted into the opening 8 and the tongue 10 formed in the flight by the opening enters the interior of the cap 9. The flight 6 is then opened out as shown in FIG. 3 and the tongue 10 opens to a cruciform shape within the metal cap 9 locating it co-axially with the spine of the flight.

Figure 4:
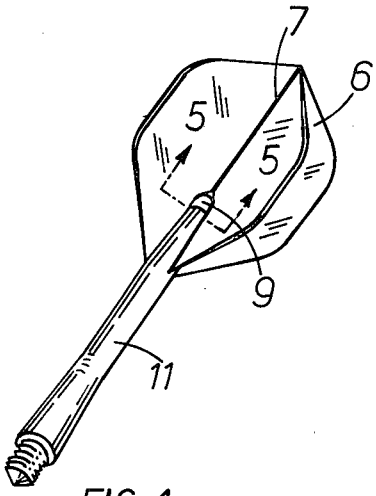
FIG. 4 is a perspective view of the assembled dart.
Figure 5:
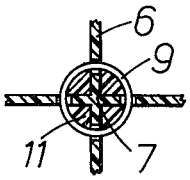
FIG. 5 is an enlarged fragmentary section on line 5—5 of FIG. 4.

The shaft of the dart, indicated by the reference numeral 11 is split at the tail end into four prongs by axial slits 12. The wings of the flight are entered in the slits 12 and slid down until, as shown in FIG. 4, the cap 9 fits over the tail end of the shaft 11 which is shaped to fit the interior of the cap 9. The cap urges the prongs towards one another and against the wings of the flight.

I claim:

1. A dart having a shaft which is slit at the tail end, a flight of which the wings are directly interconnected at the spine being received in the slits and a pointed metal cap received in openings in the wings and slidably engaging and fitting closely over the slit tail end of the shaft, urging the prongs formed between the slits toward each other and against the flight, the openings having spaced, substantially U-shaped inner and outer edges, the outer edges of the openings being of arched shape substantially conforming to the outer surface of the metal cap, and the inner edges of the openings defining around the spine a tongue which projects into the interior of the cap to locate it positively co-axially with the spine of the flight even when the flight is separated from said shaft.

2. A dart flight having wings which are directly interconnected at the spine of the flight, an opening in the wings of said flight co-axial with the spine thereof, a pointed cap received in said opening and being adapted to fit over the tail end of a shaft slit to receive the wings of said flight, said opening having outer edges of arched shape substantially conforming to the outer surface of said cap, and a tongue within the opening projecting into the interior of the cap to retain it in said opening co-axially with the spine of the flight.

3. The dart flight of claim 2 wherein the wings of said flight are foldable about said spine between a flat condition and an open condition, said tongue retaining said cap in said opening regardless of the open or closed condition of said wings.

4. The dart flight of claim 3 wherein said tongue is constructed and arranged that when said wings are folded to their open condition the tongue is also opened out to a three dimensional shape of a size to be received within said cap.

5. The dart flight of claim 4 wherein said flight has four wings and said tongue is cruciform in shape when said wings are in their open condition.

6. The dart flight of claim 2 wherein said pointed cap is metal and arranged to divert the point of a following dart which strikes it.

* * * * *

UNITED STATES PATENT AND TRADEMARK OFFICE

CERTIFICATE OF CORRECTION

PATENT NO. : 4,114,884

DATED : September 19, 1978

INVENTOR(S) : Leonard Alfred Tunnicliffe

It is certified that error appears in the above-identified patent and that said Letters Patent are hereby corrected as shown below:

Claim 1, line 36, after "interconnected" insert --at the spine of the flight, the forward marginal portions of the wings--

Signed and Sealed this

*Fifth* Day of *December 1978*

[SEAL]

*Attest:*

RUTH C. MASON
*Attesting Officer*

DONALD W. BANNER
*Commissioner of Patents and Trademarks*